US006618016B1

(12) United States Patent
Hannan et al.

(10) Patent No.: US 6,618,016 B1
(45) Date of Patent: Sep. 9, 2003

(54) EIGHT-ELEMENT ANTI-JAM AIRCRAFT GPS ANTENNAS

(75) Inventors: Peter W. Hannan, Smithtown; Alfred R. Lopez, Commack; Richard J. Kumpfbeck, Huntington, all of NY (US)

(73) Assignee: BAE Systems Aerospace Inc., Greenlawn, NY (US)

( * ) Notice: Subject to any disclaimer, the term of this patent is extended or adjusted under 35 U.S.C. 154(b) by 0 days.

(21) Appl. No.: 09/789,467

(22) Filed: Feb. 21, 2001

(51) Int. Cl.[7] ..... H01Q 1/28; H01Q 13/10
(52) U.S. Cl. ..... 343/705; 767/342; 767/2
(58) Field of Search ..... 343/705, 706, 343/708, 746, 765, 767, 797, 806, 810, 812; 342/2; H01Q 1/28, 13/10

(56) References Cited

U.S. PATENT DOCUMENTS 3,811,127 A * 5/1974 Griffee et al. ..... 343/705
5,030,965 A * 7/1991 Park et al. ..... 343/770
5,309,165 A * 5/1994 Segal et al. ..... 343/770
5,521,610 A * 5/1996 Rodal ..... 343/797
5,592,185 A * 1/1997 Itabashi et al. ..... 343/794
5,764,195 A 6/1998 Colclough et al.
5,966,102 A * 10/1999 Runyon ..... 343/820
6,195,063 B1 * 2/2001 Gabriel et al. ..... 343/797
6,333,720 B1 * 12/2001 Gotti et al. ..... 343/810

* cited by examiner

*Primary Examiner*—Don Wong
*Assistant Examiner*—Trinh Vo Dinh
(74) *Attorney, Agent, or Firm*—Edward A. Onders; Kenneth P. Robinson

(57) ABSTRACT

A compact aircraft antenna for reception of GPS signals includes eight elements to provide eight antenna patterns usable for anti-jam signal processing. Four bent monopole elements are configured with vertical portions and horizontal inward-extending portions. The bent monopole elements are arranged for multimode excitation to provide a primary progressive phase omnidirectional right-hand circularly-polarized antenna pattern for basic signal GPS signal reception. Multimode excitation of the bent monopoles also provides omnidirectional left-hand circularly-polarized, uniform phase omnidirectional, and clover leaf auxiliary antenna patterns. Four individual slot element figure-eight type auxiliary antenna patterns are also provided. With availability of these primary and auxiliary patterns, adaptive type anti-jam processing can be employed to actively provide reduced-gain antenna pattern notches or nulls at incident angles of interference or jamming signals.

34 Claims, 5 Drawing Sheets

PPO1

UPO

PPO2

CL

Four Bent Monopoles

PPO1 + UPO

PPO1 + PPO2

EIGHT-ELEMENT ANTI-JAM AIRCRAFT GPS ANTENNAS

RELATED APPLICATIONS (Not Applicable)

FEDERALLY SPONSORED RESEARCH (Not Applicable)

BACKGROUND OF THE INVENTION

This invention relates to aircraft antennas and, more particularly, to such antennas providing multiple beam excitation usable with anti-jam adaptive processing to suppress jamming and interference.

A variety of antennas have been made available for reception of Global Positioning System (GPS) signals for navigational and other purposes. A more critical objective than the mere capability to receive such signals, is the objective of enabling reception in the presence of interference or jamming signals. Interference may be the unintended result of reception of signals radiated for some purpose unrelated to GPS operations. Jamming, on the other hand, may involve signals intentionally transmitted for the purpose of obstructing reception of GPS signals. In aircraft operations which are dependent upon use of GPS signals, deleterious effects of interference or jamming may be particularly disruptive.

For reception via a fixed-position antenna in the presence of interference signals incident from a fixed azimuth, for example, a reduced-gain antenna pattern notch aligned to suppress reception at the appropriate azimuth may be employed as an effective solution. However, for aircraft operations a more complex solution is required. With an aircraft and its antenna operable in a variety of geographical locations and conditions, with constantly changing azimuth orientation during flight, interference or jamming signals may be incident from any azimuth and with constantly changing azimuth. At the same time, aircraft maneuvers, such as banked turns, tilt the aircraft and its antenna so that the interference or jamming signals may be incident from different and changing elevation angles.

A variety of adaptive processing techniques have previously been described. Such techniques typically provide an antijam capability based on provision of reduced-gain antenna pattern notches and alignment of such notches at the incident azimuth of undesired incoming signals. However, to enable practical employment of such techniques for aircraft reception of GPS signals, small, reliable, low-cost, low-profile antennas providing a multi-beam capability suitable for anti-jam application are required.

Accordingly, objects of the present invention are to provide new and improved aircraft antennas having one or more of the following characteristics and capabilities:

- low-profile configuration of four bent monopoles and four slot elements;
- eight elements with eight beam excitation capability;
- omnidirectional circularly-polarized principal beam;
- seven selectively excitable auxiliary beams;
- full upper-hemisphere beam coverage;
- multiple elements for omnidirectional and other coverage;
- small-size, low-profile implementation;
- high-performance, high-reliability design;

- excitable in a variety of beam configurations for anti-jam applications; and
- controllable pattern excitation suitable for adaptive processing anti-jam operation.

SUMMARY OF THE INVENTION

In accordance with the invention, an eight-element anti-jam aircraft antenna includes a cavity assembly, four slot elements and four bent monopole elements. The cavity assembly includes a conductive upper surface spaced above a conductive lower surface. The four slot elements each include a slot in the upper surface configured as a radiating element. The slot elements are arrayed around a vertical axis and extend radially relative to that axis. The four bent monopole elements extend above the upper surface of the cavity assembly and are arrayed around the vertical axis. Each bent monopole element includes an upward-extending first portion and a second portion extending inward toward the vertical axis. The antenna also includes a coupling assembly coupled to the slot elements and bent monopole elements to couple signals for an omnidirectional antenna pattern and a plurality of additional antenna patterns.

The slot elements may be arrayed around the vertical axis at successive angular separations of 90 degrees and the bent monopole elements may be similarly arrayed around that axis.

The coupling assembly of the antenna may be arranged:

(i) to provide 90 degree progressive phase excitation of the bent monopole elements to form a right-hand circularly-polarized omnidirectional antenna pattern;

(ii) to provide 90 degree progressive phase excitation of the bent monopole elements to form a left-hand circularly-polarized omnidirectional antenna pattern;

(iii) to provide same phase excitation of the bent monopole elements to form a uniform phase omnidirectional antenna pattern;

(iv) to provide 180 phase progressive excitation of the bent monopole elements to form a four-lobe antenna pattern; and (v) to provide four figure-eight type patterns at different azimuth orientations by excitation of the slot elements.

For a better understanding of the invention, together with other and further objects, reference is made to the accompanying drawings and the scope of the invention will be pointed out in the accompanying claims.

DESCRIPTION OF THE INVENTION

Figure 1:
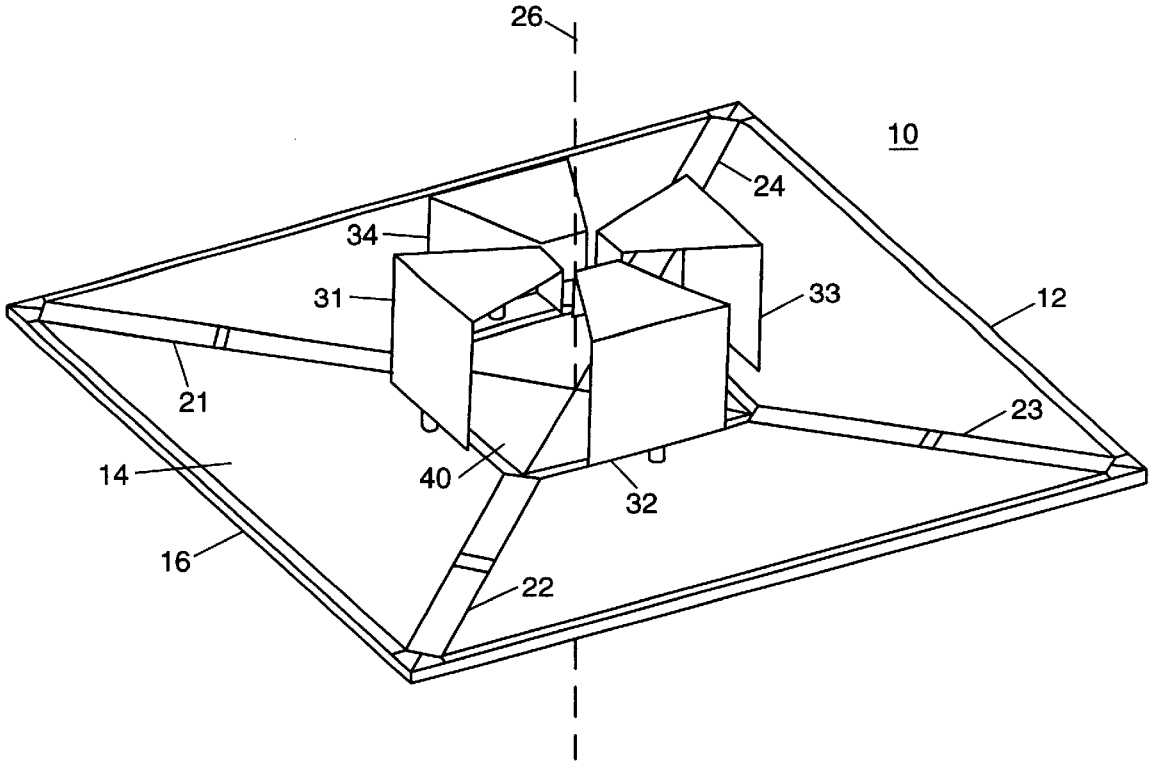
FIG. 1 illustrates an eight-element anti-jam aircraft antenna in accordance with the invention, which includes four slot elements and four bent monopole elements.

FIG. 1 is a view of an eight-element anti-jam aircraft antenna 10 pursuant to the invention. For airborne dual-band GPS reception, the FIG. 1 antenna may have overall dimensions of approximately five inches, by five inches, by one and one-half inches in height. As will be described, this antenna can be arranged to provide a principal omnidirective circularly-polarized antenna pattern, together with seven additional selectable multi-mode or other antenna patterns.

The FIG. 1 antenna includes a cavity assembly 12 having a conductive upper surface 14 spaced above a conductive lower surface 16. In FIG. 1, upper surface 14 is provided by a printed circuit board and lower surface 16 (not visible in this view) is formed of metal sheet material. Cavity assembly 12, in this configuration, also includes a vertical peripheral conductive sidewall and internal vertical conductive partitions separating space within into four sections, one for each slot element (see partitions 15 in FIG. 4B).

As illustrated, the antenna includes four slot elements 21, 22, 23, 24, each including a slot in upper surface 12. Each slot is configured as a radiating element with inclusion of an internal cross-slot excitation stub fed via a coaxial connector extending through the lower surface of cavity assembly 12, as will be further described. As shown in FIG. 1, the slot elements 21-24 are arrayed in spaced relation around a vertical axis 26. The slot elements thus extend radially relative to the vertical axis and are spaced in azimuth at successive 90 degree angular displacements.

Also included are four bent monopole elements 31, 32, 33, 34, which extend above upper surface 14 and are arrayed in spaced relation around the vertical axis 26. Each of the bent monopole elements 31, 32, 33, 34 includes, as shown, an upward-extending first portion and a second portion extending inward toward the vertical axis. The bent monopole elements are thus arrayed in two interspersed opposing pairs with respective second portions of each pair extending horizontally toward each other. Operatively, the horizontal second portions have vertical radiation characteristics enhancing provision of a hemispherical antenna pattern with elevation coverage from horizontal to vertical (0 to 90 degrees in elevation).

The FIG. 1 antenna 10 includes a coupling assembly 40 represented as a circuit panel positioned contiguous to upper surface 14 and central to the first portions of the bent monopole elements 31–34. Coupling assembly 40, as shown, is positioned within the periphery of the bent monopole elements, and may include coaxial connectors and other elements which extend below upper surface 14 into a central portion of the cavity assembly which is partitioned off from individual cavity portions utilized for the slot elements 21–24. As will be further described, coupling assembly 40 is coupled to the bent monopole elements to couple signals for an omnidirectional antenna pattern and a plurality of additional antenna patterns. For this purpose, coupling assembly 40 may typically include a beam-forming network of the type to be described.

As an example, the coupling assembly may include a beam-forming network connected to each of bent monopole elements 31–34 and an individual input/output port for each of slot elements 21–24, so as to make available the following eight antenna patterns (i.e., beams):

(i) a right-hand circularly-polarized ("RHCP") omnidirectional antenna pattern;

(ii) a left-hand circularly-polarized ("LHCP") omnidirectional antenna pattern;

(iii) a uniform phase omnidirectional antenna pattern;

(iv) a four-lobe ("clover leaf") antenna pattern; and (v) four figure-eight type antenna patterns, representing a typical form of slot antenna pattern for each of slot elements 21–24, with pattern alignment determined by the physical alignment of the respective slot element in the FIG. 1 antenna.

With availability of these eight antenna patterns, the RHCP omni pattern can be utilized as the primary antenna pattern for reception of GPS signals. With the employment of bent monopole elements as shown, this pattern provides omnidirectional coverage in azimuth, as well as excellent coverage in elevation from horizon to zenith (i.e., hemispherical coverage). The remaining seven antenna patterns (i.e., the auxiliary patterns) may be employed pursuant to adaptive processing anti-jam techniques to actively combine one or more of such patterns with the primary RHCP pattern in order to form and orient reduced-gain antenna pattern notches to suppress reception of interference and jamming signals. Using such techniques, the presence of interference and jamming signals can be constantly monitored and suppression actively implemented. With the eight patterns available from the present antenna, skilled persons will be enabled to implement a variety of anti-jam signal processing techniques as appropriate to particular implementations and applications of antennas employing the invention.

Figure 2:
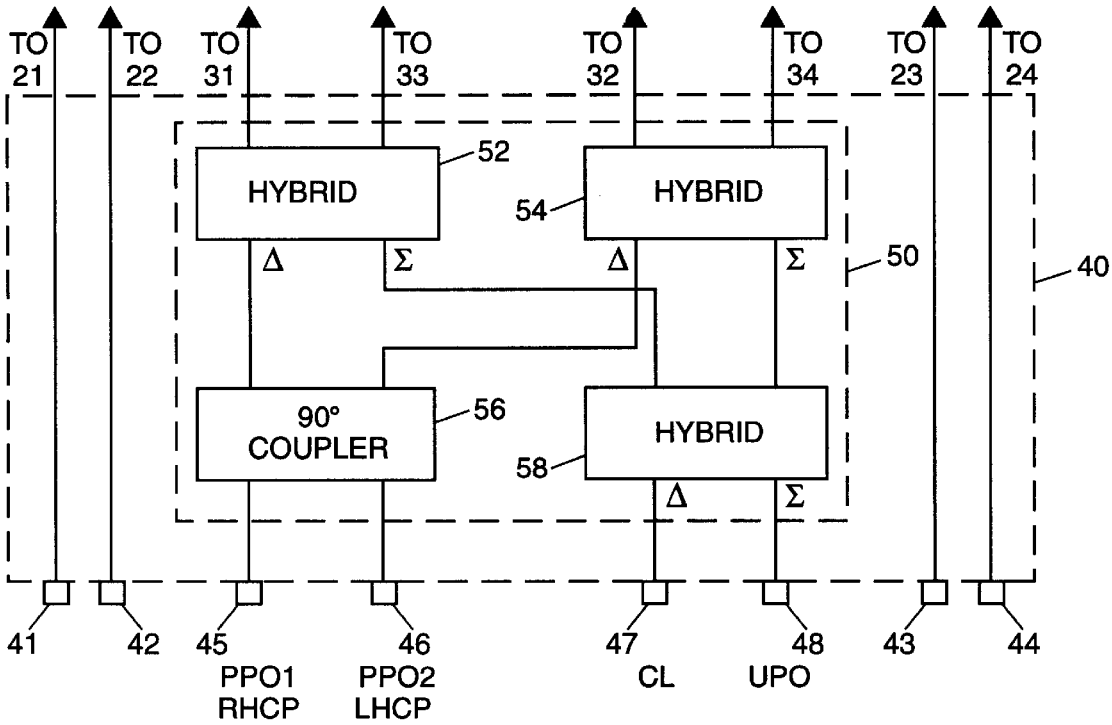
FIG. 2 is a block diagram of a coupling assembly usable in the FIG. 1 antenna.

Referring now to FIG. 2, there is shown a block diagram of an embodiment of coupling assembly 40 which may be included in the FIG. 1 antenna. In FIG. 2, coupling assembly 40 includes a beam-forming network 50 indicated as including connections to bent monopole elements 31, 32, 33, 34 and connections to slot elements 21, 22, 23, 24. As shown, the slot elements are directly coupled to output ports 41, 42, 43, 44, which may typically be coaxial connectors accessible at the bottom of antenna 10. Beam-forming network 50 is coupled to output ports 45, 46, 47, 48, which may also be coaxial connectors accessible at the bottom of the antenna. The network 50 is effective to provide access to multi-mode antenna pattern excitations at the output ports 45–48, as will be described further.

As illustrated, bent monopole elements 31 and 33 are coupled to hybrid junction 52 of network 50, and bent monopole elements 32 and 34 are coupled to hybrid junction 54 thereof. Each hybrid junction has respective delta and sigma ports at which signals representative of differences and sums of input signals (e.g., from elements 31 and 33 for hybrid 52) are made available. The delta and sigma ports of hybrid junctions 52 and 54 are connected, as shown, to 90 degree coupler 56 (which may be a suitable directional coupler) and to hybrid junction 58. With this configuration, PP01 excitation (indicating progressive phase omni excitation with RHCP polarization) available via port 45 represents respective excitation phases of 0, −09, −180, −270 degrees for monopole elements 31, 32, 33, 34. PP02 excitation (progressive phase omni, LHCP) via port 46 represents respective excitation phases of 0, 90, 180, 270 degrees for elements 31, 32, 33, 34. CL excitation (four-lobe or clover leaf) via port 47 represents respective excitation phases of 0, 180, 0, 180 degrees for elements 31–34. UPO excitation (uniform phase omni) via port 48 represents respective excitation phases of 0, 0, 0, 0 degrees for elements 31, 32, 33, 34. With an understanding of the invention, skilled persons will be enabled to implement specific embodiments of beam-forming network 50 for particular applications, pursuant to established techniques.

In summary, beam-forming network 50 thereby provides access to the following four orthogonal multimode antenna pattern excitations via output ports of coupling assembly 40:

(i) at port 45, a right-hand circularly-polarized omnidirectional antenna pattern (PP01);

(ii) at port 46, a left-hand circularly-polarized omnidirectional antenna pattern (PP02);

(iii) at port 48, a uniform phase omnidirectional antenna pattern (UPO); and (iv) at port 47, a four-lobe (clover leaf) antenna pattern (CL).

Figure 7:
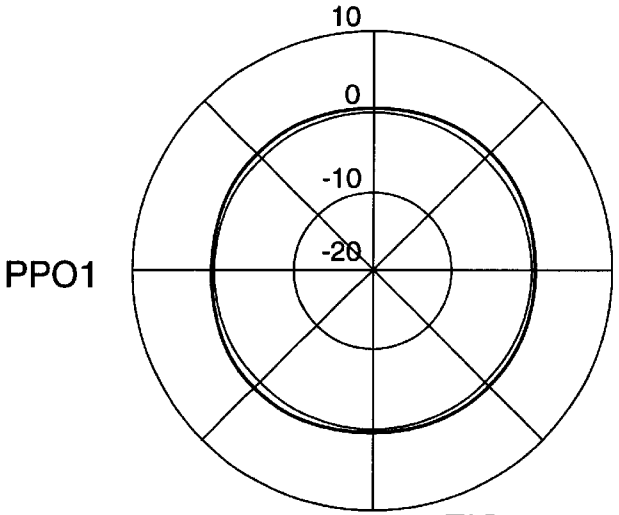
FIGS. 7, 8, 9 and 10 are azimuth-plane gain patterns for multimode excitations of the four bent monopole elements.
Figure 9:
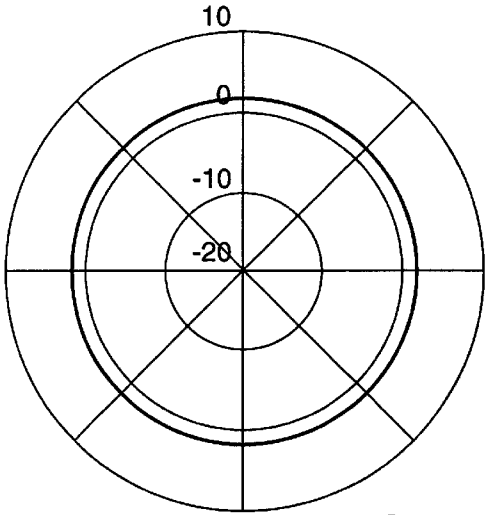
Figure 8:
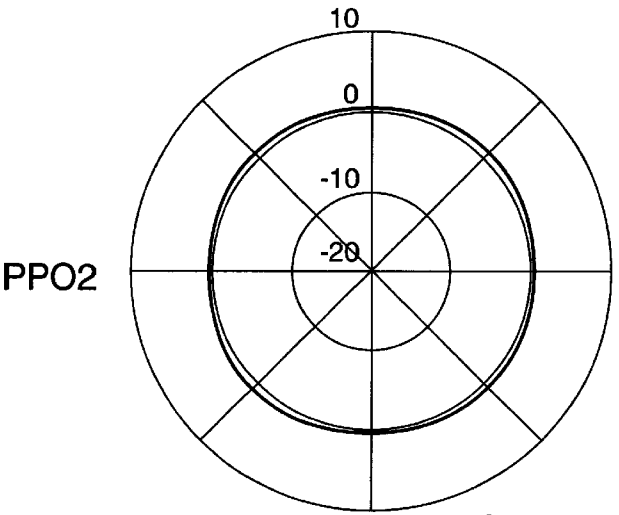
Figure 10:
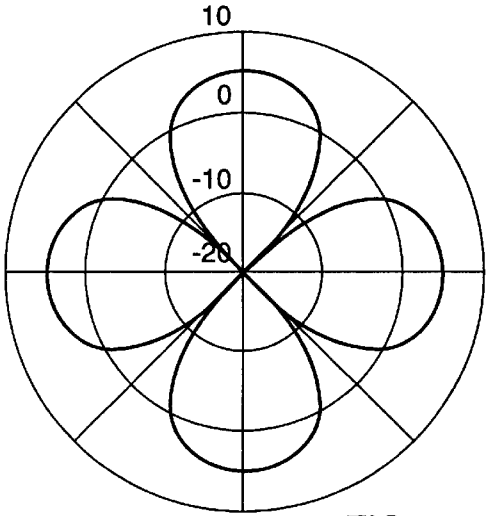

These multimode patterns are illustrated in the azimuth-plane gain patterns of FIGS. 7–10, which were computer generated for an operating frequency of 1.23 GHz and an elevation angle of 0 degrees. In the antenna pattern presentations the radial scale represents gain in dBiRC (with RC indicating right circular polarization). FIGS. 7, 8 and 9 show the omnidirectional characteristics of the PP01, PP02, and UPO antenna patterns, respectively. FIG. 10 shows the clover leaf characteristic of the CL antenna pattern. While not illustrated, a slot element antenna pattern of figure-eight type configuration (as known for typical slot excitation) is provided via ports 41, 42, 43, 44 for each of the slot elements 21, 22, 23, 24, respectively. Each of these figure-eight antenna patterns will represent an azimuth orientation differing by 90 degree increments.

Figure 11:
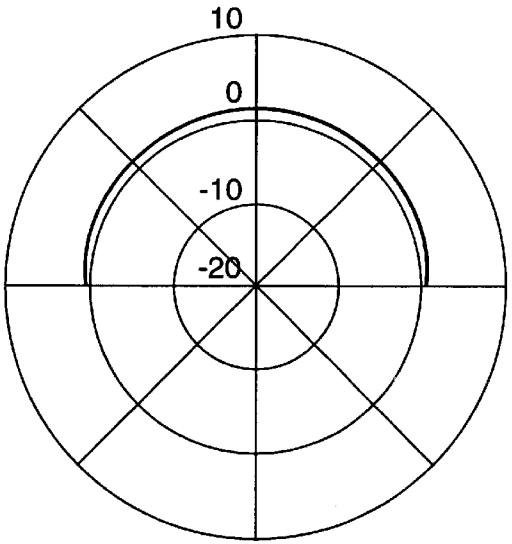
FIG. 11 is an elevation-plane gain pattern for multimode excitations of the four bent monopole elements.

The antenna pattern of FIG. 11 illustrates elevation-plane gain in dBiRC. FIG. 11 provides a representative pattern with hemispherical coverage from horizon to zenith for the PP01 and PP02 multimode antenna patterns. While not illustrated, the UPO and CL elevation plane patterns provide a null at the zenith.

Figure 3C:
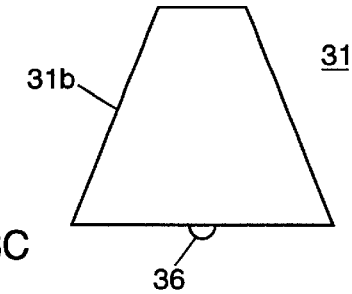
FIGS. 3A, 3B and 3C are front, side and plan views of a bent monopole element.
Figure 3B:
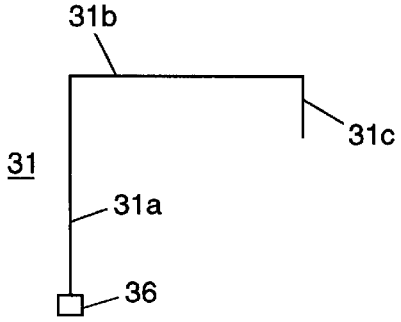
Figure 3A:
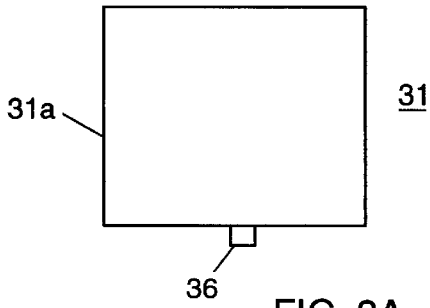

FIGS. 3A, 3B and 3C are respectively front, side and plan views of a form of bent monopole element suitable for use in antenna 10 of FIG. 1. Dimensions are not necessarily to scale. As shown, representative element 31 includes an upward-extending first portion 31*a* and a second portion 31*b* which, when the element 31 is installed in antenna 10, extends inward toward vertical axis 26. For performance optimization, this configuration also includes a downward extending tab portion 31*c*. Element 31 is provided with a coaxial conductor 36 mounted along its lower edge, with the center conductor of the connector in electrical contact with element 31 and the outer conductor isolated therefrom. With this configuration, bent monopole element 31 can be installed in antenna 10 by merely mating connector 36 with an appropriate connector mounted through upper surface 14 of the antenna. Structural stability for this form of construction can be provided by inclusion of suitably formed pieces of dielectric foam positioned to support the four bent monopole elements in the FIG. 1 arrangement. Other forms and configurations of bent monopole elements can be provided by skilled persons for particular implementations of the invention.

Figure 4A:
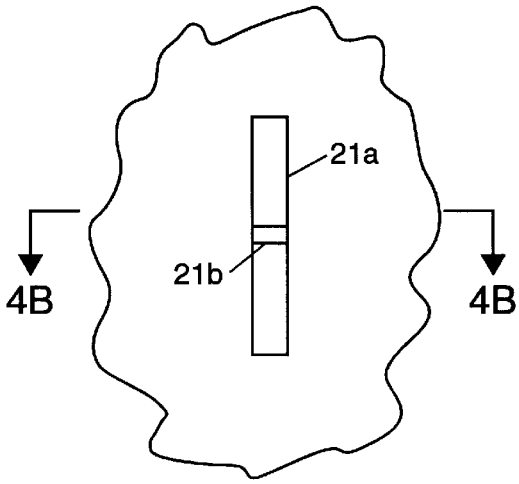
FIGS. 4A and 4B are plan and sectional views of a slot element.
Figure 4B:
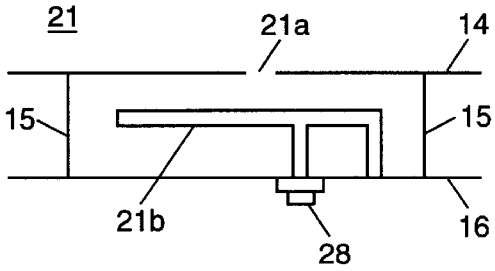

FIG. 4A is a plan view, and FIG. 4B is a sectional view along line I—I of FIG. 4A, showing features of a slot element suitable for use in antenna 10 of FIG. 1. Dimensions are not necessarily to scale. In FIG. 4B, slot element 21 includes a slot 21*a* and an excitation line section, shown as a quarter-wave short-circuited stub 21*b*. Slot 21*a* is formed in a section of the conductive upper surface 14 of the cavity assembly 12. Stub 21*b* is positioned below upper surface 14 in an individual cavity provided for slot element 21 within the space between upper and lower surfaces 14 and 16 and constrained to provide an individual slot cavity of appropriate dimensions by inclusion of conductive dividing walls or partitions as represented at 15 in FIG. 4B. As illustrated, stub 21*b*, fabricated with appropriate dimensions consistent with established design techniques for slot excitation, is shorted to lower surface 16 at one end and connected to coaxial connector 28 extending through lower surface 16. Other forms and configurations of slot elements and excitation members can be provided by skilled persons for particular implementations of the invention.

Figure 5:
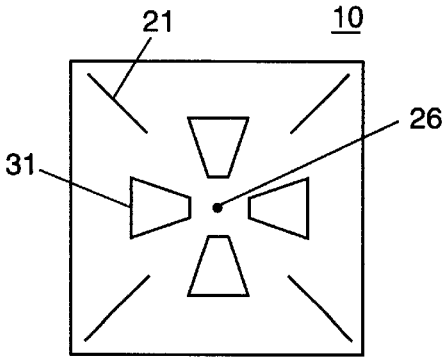
FIGS. 5 and 6 are simplified plan views of two slot/bent monopole alignment configurations.
Figure 6:
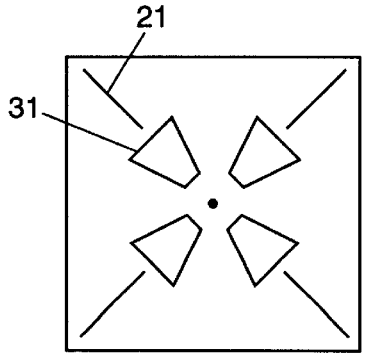

FIGS. 5 and 6 are simplified plan views of eight-element aircraft antennas utilizing the invention. As shown in each of FIGS. 5 and 6, the slot elements (of which 21 is representative) are arrayed around vertical axis 26 (appearing in end view, as a dot) at successive angular separations of nominally 90 degrees. The bent monopole elements (of which 31 is representative) are also arrayed around the axis at successive angular separations of nominally 90 degrees. As will be seen, a difference between the configurations of FIGS. 5 and 6 is that whereas in FIG. 5 each bent monopole element is positioned at angular separations of nominally 45 degrees relative to each of two slot elements (i.e., the adjacent slot elements), in FIG. 6 the slot elements and bent monopole elements are positioned at coincident angular positions relative to the vertical axis 26. While the 90 degree angular separation between similar elements may be selected for purposes of omnidirectional symmetry, other operational and construction considerations may affect the number and positioning of elements and the positioning of the elements of the array of one type of element relative to the array of the second type of element. In a currently preferred embodiment the FIG. 6 type coincident alignment is used. For purposes hereof, the term "nominally" is defined as covering a range of ±15 degrees or ±5 percent of a stated value or relationship.

Figure 13:
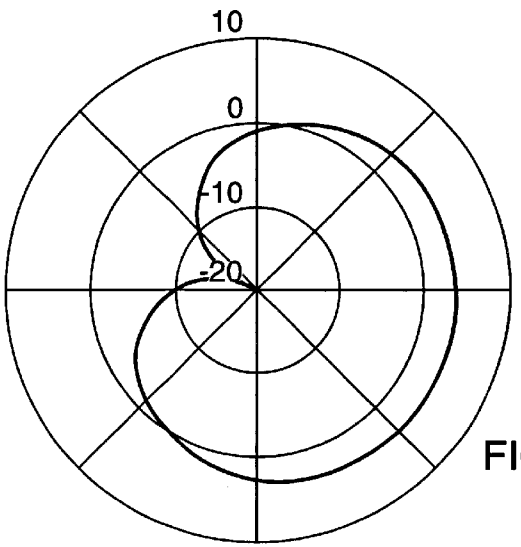
FIGS. 12 and 13 are azimuth-plane gain patterns representing pattern combinations by anti-jam processing to provide reduced-gain pattern notches for interference or jamming suppression.
Figure 12:
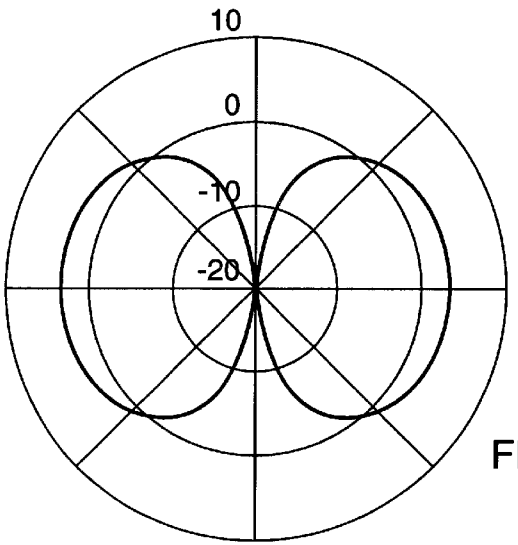

As referred to above, antennas pursuant to the invention provide a plurality of antenna patterns or beams which are suitable for use for anti-jam processing. FIG. 12 illustrates results of a combination of the PP01 and PP02 antenna patterns to provide in an effective excitation pattern having reduced-gain notches or nulls at both 0 and 180 degree azimuth orientations. FIG. 13 illustrates results of a combination of the PP01 and UPO antenna patterns to provide an effective excitation pattern having a notch with an azimuth orientation of about −60 degrees. Skilled persons are familiar with established techniques involving adaptive processing, for example, whereby on an active continuing basis one or more reduced-gain antenna pattern notches can be steered to or provided at the azimuth or azimuths appropriate to suppress reception of incoming interference or jamming signals.

Thus, a jamming signal which could interfere with or prevent reliable reception of GPS signals may be incident on a receiving antenna at a fixed or changing azimuth, for example. Provision of a reduced-gain antenna pattern notch at such azimuth can suppress or reduce reception of disruptive jamming signals. Adaptive processing techniques with extensive anti-jam capabilities can be employed, subject, however, to availability of an adequate number and variety of different antenna patterns having varying characteristics. The FIG. 1 antenna, as already described, provides eight antenna patterns of different form and angular orientation. The PP01 pattern providing omnidirectional coverage, with circular polarization and hemispherical coverage in elevation, can be employed as the primary beam for reception of GPS signals. The remaining seven antenna patterns, including differently phased omni patterns, a clover leaf pattern, and slot element patterns of four different angular orientations, are available for use as auxiliary beams in combinations to provide notches or nulls when and where needed.

A specific embodiment of the FIG. 1 type antenna with element alignment as in FIG. 6 was designed for GPS signal reception in the LI (1563.42 to 1587.42 MHZ) and L2 (1215.6 to 1239.6 MHZ) bands. Dimensions of the antenna were approximately 7 inches, by 7 inches, by 1.5 inches in height. The cavity assembly and the bent monopole elements were constructed basically of sheet metal, with dielectric foam support provided for the bent monopole elements. The cavity assembly encompassed four cavities for the slot elements and a central space for the feed network. The slots for the slot elements were etched on the lower side of a printed circuit board, with matching elements and other circuitry provided on the upper side of such board. A low-profile plastic radome was included for air flow streamlining and element protection. A gain greater than −3.5 dBiRC omnidirectionally and from 5 to 90 degrees elevation, with VSWR of 1.5:1, was calculated, after adjustment for the loss associated with the coupling assembly (e.g., including beam forming network 50).

While there have been described the currently preferred embodiments of the invention, those skilled in the art will recognize that other and further modifications may be made without departing from the invention and it is intended to claim all modifications and variations as fall within the scope of the invention.

What is claimed is:

1. An aircraft antenna, comprising:

a cavity assembly including a conductive upper surface spaced above a conductive lower surface;

four slot elements, each including a slot in said upper surface configured as a radiating element, said slot elements arrayed around a vertical axis and extending radially relative thereto;

four bent monopole elements extending above said upper surface and arrayed around said vertical axis, each bent monopole element including an upward-extending first portion and a second portion extending inward toward the vertical axis; and a coupling assembly coupled to said bent monopole elements to couple signals for an omnidirectional antenna pattern and a plurality of additional antenna patterns.

2. An aircraft antenna as in claim 1, wherein the coupling assembly includes a beam-forming network arranged to provide (i) a first circularly-polarized omnidirectional antenna pattern.

3. An aircraft antenna as in claim 2, wherein the beam-forming network is additionally arranged to provide (ii) a second circularly-polarized omnidirectional antenna pattern, (iii) a uniform phase omnidirectional antenna pattern, and (iv) a four-lobe antenna pattern.

4. An aircraft antenna as in claim 3, wherein said first and second circularly-polarized antenna patterns are respectively characterized by right-hand and left-hand circular polarization.

5. An aircraft antenna as in claim 1, wherein the cavity assembly includes an individual cavity section below each slot element.

6. An aircraft antenna as in claim 1, wherein said slot elements are arrayed around said vertical axis at successive angular separations of nominally 90 degrees, and said bent monopole elements are also arrayed around the vertical axis at successive angular separations of nominally 90 degrees.

7. An aircraft antenna as in claim 6, wherein each bent monopole element is positioned at angular separations of nominally 45 degrees relative to each of two slot elements.

8. An aircraft antenna as in claim 6, wherein the slot elements and bent monopole elements are positioned at coincident angular positions relative to the vertical axis.

9. An aircraft antenna as in claim 1, wherein each slot element includes an excitation line section positioned below the upper surface of the cavity assembly.

10. An aircraft antenna as in claim 9, wherein said excitation line section is a short-circuited quarter-wave stub positioned in a cross-slot alignment.

11. An aircraft antenna as in claim 1, wherein each bent monopole element includes a thin rectangular vertical first portion and a thin horizontal second portion of diminishing width in the direction toward said vertical axis.

12. An aircraft antenna as in claim 1, wherein each bent monopole element is supported above the upper surface of the cavity assembly by a coaxial connector extending through said upper surface.

13. An aircraft antenna as in claim 1, wherein the coupling assembly is centrally positioned within the periphery of the bent monopole element array.

14. An aircraft antenna as in claim 1, wherein the coupling assembly includes a coupling network with four output ports and an individual output port for each slot element.

15. An aircraft antenna, comprising:

a cavity assembly including a conductive upper surface spaced above a conductive lower surface;

four slot elements, each including a slot in said upper surface configured as a radiating element, said slot elements arrayed around a vertical axis and extending radially relative thereto;

four bent monopole elements extending above said upper surface and arrayed around said vertical axis, each bent monopole element including an upward-extending first portion and a second portion extending inward toward the vertical axis; and a coupling assembly coupled to said bent monopole elements:

(i) to provide 90 degree progressive phase excitation of the bent monopole elements to form a right-hand circularly-polarized omnidirectional antenna pattern;

(ii) to provide 90 degree progressive phase excitation of the bent monopole elements to form a left-hand circularly-polarized omnidirectional antenna pattern;

(iii) to provide same phase excitation of the bent monopole elements to form a uniform phase omnidirectional antenna pattern; and (iv) to provide 180 phase progressive excitation of the bent monopole elements to form a four-lobe antenna pattern.

16. An aircraft antenna as in claim 15, wherein the coupling assembly additionally provides excitation of each of the four slot elements individually.

17. An aircraft antenna as in claim 15, wherein said slot elements are arrayed around said vertical axis at successive angular separations of nominally 90 degrees, and said bent monopole elements are also arrayed around the vertical axis at successive angular separations of nominally 90 degrees.

18. An aircraft antenna as in claim 15, wherein each bent monopole element is positioned at angular separations of nominally 45 degrees relative to each of two slot elements.

19. An aircraft antenna as in claim 15, wherein the slot elements and bent monopole elements are positioned at coincident angular positions relative to the vertical axis.

20. An aircraft antenna as in claim 15, wherein each slot element includes an excitation line section positioned below the upper surface of the cavity assembly.

21. An aircraft antenna as in claim 15, wherein each bent monopole element includes a thin rectangular vertical first portion and a thin horizontal second portion of diminishing width in the direction toward said vertical axis.

22. An aircraft antenna as in claim 15, wherein the coupling assembly includes a coupling network with four output ports and an individual output port for each slot element.

23. An aircraft antenna, comprising:

a cavity assembly including a conductive upper surface spaced above a conductive lower surface;

a plurality of slot elements, each including a slot in said upper surface configured as a radiating element, said slot elements arrayed around a vertical axis; and a plurality of bent monopole elements extending above said upper surface and arrayed around said vertical axis, each bent monopole element including an upward-extending first portion and a second portion extending inward toward the vertical axis.

24. An aircraft antenna as in claim 23, additionally comprising:

a coupling assembly coupled to said bent monopole elements to couple signals for a plurality of antenna patterns.

25. An aircraft antenna as in claim 24, wherein the coupling assembly includes a beam-forming network arranged to provide (i) a first circularly-polarized omnidirectional antenna pattern.

26. An aircraft antenna as in claim 25, wherein the beam-forming network is additionally arranged to provide (ii) a second circularly-polarized omnidirectional antenna pattern, (iii) a uniform phase omnidirectional antenna pattern, and (iv) a four-lobe antenna pattern.

27. An aircraft antenna as in claim 23, wherein each bent monopole element includes a thin rectangular vertical first portion and a thin horizontal second portion of diminishing width in the direction toward said vertical axis.

28. An aircraft antenna, comprising:

four bent monopole elements arrayed around a vertical axis, each bent monopole element including an upward-extending first portion and a second portion extending inward toward the vertical axis; and a coupling assembly coupled to said bent monopole elements, the coupling assembly configured to provide:

(i) 90 degree progressive phase excitation of the bent monopole elements to form a first circularly-polarized omnidirectional antenna pattern;

and to additionally provide at least one of:

(ii) 90 degree progressive phase excitation of the bent monopole elements to form a second circularly-polarized omnidirectional antenna pattern;

(iii) same phase excitation of the bent monopole elements to form a uniform phase omnidirectional antenna pattern; and (iv) 180 phase progressive excitation of the bent monopole elements to form a four-lobe antenna pattern.

29. An aircraft antenna as in claim 28, wherein the coupling assembly is configured to provide all of the four excitations as specified in subparagraphs (i), (ii), (iii) and (iv).

30. An aircraft antenna as in claim 28, wherein said bent monopole elements are arrayed around the vertical axis at successive angular separations of nominally 90 degrees.

31. An aircraft antenna as in claim 28, wherein each bent monopole element includes a thin rectangular vertical first portion and a thin horizontal second portion of diminishing width in the direction toward said vertical axis.

32. An aircraft antenna as in claim 28, wherein the coupling assembly comprises a beam-forming network.

33. An aircraft antenna, comprising:

a cavity assembly including a conductive upper surface spaced above a conductive lower surface;

a plurality of slot elements, each including a slot in said upper surface configured as a radiating element, said slot elements arrayed around a vertical axis; and a plurality of bent monopole elements extending above said upper surface and arrayed around said vertical axis, each bent monopole element including an upward-extending first portion and a second portion extending inward toward the vertical axis;

said slot elements arrayed around said vertical axis at successive angular separations of nominally 90 degrees and said bent monopole elements also arrayed around the vertical axis at successive angular separations of nominally 90 degrees.

34. An aircraft antenna as in claim 33, wherein each bent monopole element is positioned at angular separations of nominally 45 degrees relative to each of two slot elements.

* * * * *